US006915752B2

(12) United States Patent
Taber et al.

(10) Patent No.: US 6,915,752 B2
(45) Date of Patent: Jul. 12, 2005

(54) UTILITY SERVICE PROTECTION STRIP

(75) Inventors: Alan E. Taber, Moorestown, NJ (US); Jesse Cugliotta, Southampton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/674,716

(22) Filed: Sep. 30, 2003

(65) Prior Publication Data

US 2005/0066873 A1 Mar. 31, 2005

(51) Int. Cl.[7] ..... B63B 17/00
(52) U.S. Cl. ..... 114/65 R; 114/343
(58) Field of Search ..... 114/65 R, 343

(56) References Cited

U.S. PATENT DOCUMENTS 4,602,124 A * 7/1986 Santucci ..... 174/101

* cited by examiner

*Primary Examiner*—Sherman Basinger
(74) *Attorney, Agent, or Firm*—Duane Morris LLP

(57) ABSTRACT

A modular kit of parts covers utility service lines extending from a bulkhead to a mission module. The kit includes a standard-length U-channel with a baseplate and upstanding sides. The baseplate defines one or more longitudinal slots, each of which defines a given width. A cover is provided. The kit also includes a divider having a protruding edge portion dimensioned to be accommodated in the slot. One embodiment includes a tee-shaped protrusion for use in a tee-shaped slot, and another embodiment includes a stress-reducing flange.

12 Claims, 7 Drawing Sheets

UTILITY SERVICE PROTECTION STRIP

FIELD OF THE INVENTION

This invention relates to arrangements for protecting utility connections extending between a bulkhead and a mission module placed at a distance from the bulkhead.

BACKGROUND OF THE INVENTION

Modern ships are modular, in that many of the payload portions are modules that can be installed or adapted to any ship to perform a desired function. FIG. 1*a* is a simplified perspective or isometric view of a ship portion 100 including a portion 110 of a deck (interior or exterior) and a bulkhead 112. A mission module 114 is mounted on the deck 110. Various utility sources or connections are attached to bulkhead 112. More particularly, an electrical socket 116 provides alternating voltage for operating the mission module 114, and pipe outlets 118*a* and 118*b* provide for flow of coolant water. Other connections, such as 120, may be provided. Connections 120 may be for sensors or for optical fiber communications, or the like. FIG. 1*b* is an elevation view of bulkhead 112, showing the connections.

As illustrated in FIG. 1*a*, some of the various utility connections 116, 118*a*, 118*b*, and 120 are connected to the mission module 114. More particularly, electrical connection 116 is connected to mission module 114 by way of an electrical cable 121, and water connections are made between pipe outlets 118*a* and 118*b* and the mission module by hoses or pipes 122*a*, 122*b*. It will be understood that there must be a reasonable amount of room or distance between the mission module 114 and bulkhead 112, so that the various connections can be made. Thus, there is likely to be a significant length of connection cables, wires, pipes, or hoses extending between the bulkhead and the module. Such connections pose a hazard for personnel in the area, especially considering that a shipboard environment is not always stable, given that rolling and heaving occur during inclement weather or possibly during battle. It is desirable to protect personnel from potential injury due to contact with the utility connection lines, and to protect the utility lines themselves from damage.

SUMMARY OF THE INVENTION

A kit of parts according to an aspect of the invention comprises at least one U-channel. The U-channel comprises a planar baseplate defining upper and lower broad surfaces. The U-channel has a predetermined length in a length direction, and a width between first and second sides extending parallel to the length direction. The predetermined length is no greater than the distance between a bulkhead and a mission module between which the baseplate will installed. The U-channel further comprises first and second planar mutually parallel walls, each having the predetermined length in the length direction. The first wall is attached to the first side of the baseplate, with the length direction of the first wall parallel with the length direction of the baseplate. The first wall has a width dimension. The first wall extends above the upper side of the baseplate, orthogonal to the upper broad surface of the baseplate. The second wall is attached to the second side of the baseplate, with the length direction of the second wall parallel with the length direction of the baseplate. The second wall has a width dimension. The second wall extends above the upper side of the baseplate and orthogonal to the upper broad surface of the baseplate. The first and second walls, together with the baseplate, define a generally U-shaped channel defining a length in a direction parallel with the length direction, and also defining a channel width. The baseplate further comprises at least a first slot in the upper surface of the baseplate. The first slot has a length extending parallel with the length direction. The first slot has at least a first predetermined width dimension. The kit of parts further includes a divider comprising a generally planar rectangular element defining a length dimension equal to the predetermined length dimension, a width dimension approximately equal to the width dimension of the first and second walls, and a first thickness along at least a selected portion of the edges thereof which is no greater than the first predetermined width of the slot. A generally planar rectangular cover is included. The cover has a length dimension equal to the predetermined length, and a width dimension approximately equal to the channel width.

In a preferred embodiment of this aspect of the invention, the baseplate of the kit of parts further comprises at least a second slot in the upper surface of the baseplate. The second slot extends parallel with the length direction and with the first slot. The second slot has at least the first predetermined width dimension. If desired, the kit of parts may further comprise a second divider comprising a generally planar rectangular element defining a length dimension equal to the predetermined length dimension, a width dimension approximately equal to the width dimension of the first and second walls and a first thickness along at least a selected portion of an edge thereof which equals the first predetermined width of the slot. In one particularly advantageous embodiment of this aspect of the invention, the first divider comprises a monolithic flange adjacent the selected portion thereof.

According to another most preferred embodiment of this aspect of the invention, the first slot of the baseplate of the kit of parts comprises a first portion having the width. The first slot portion is adjacent to the upper surface of the baseplate and remote from the lower surface of the baseplate. The first slot also comprises a second slot portion having a second width, where the first width is less than the second width. The second portion of the first slot is continuous with the first slot portion. In this most preferred embodiment, the divider has a region having a second thickness, greater than the first thickness adjacent the selected portion, and has a region having the first thickness at a location adjacent the region having the second thickness and more remote from the selected portion of the divider.

DESCRIPTION OF THE INVENTION

Figure 1A:
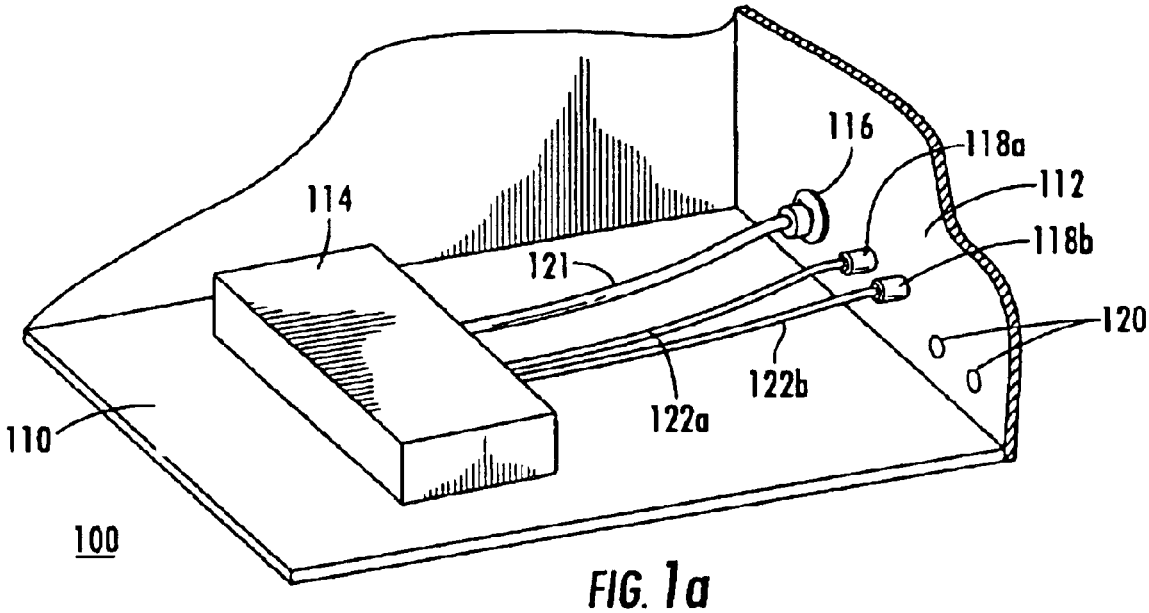
FIG. 1*a* is a simplified perspective or isometric view, partially cut away, of a shipboard environment including a deck, a bulkhead, and a mission module.
Figure 1B:
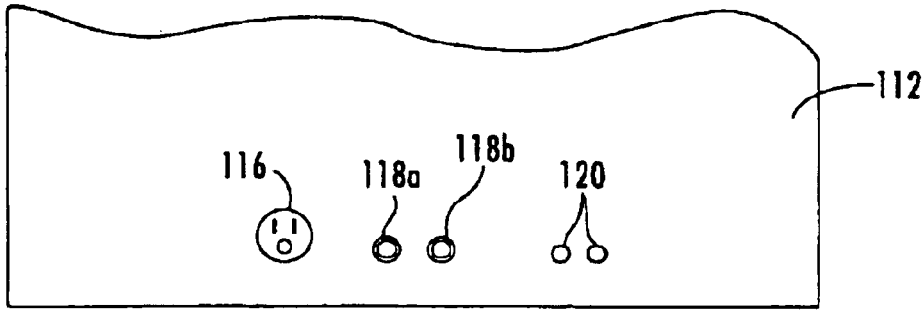
FIG. 1*b* is an elevation view of the bulkhead of FIG. 1*a*, illustrating various utility connections for electricity, water, and communications.

In FIG. 1*a*, an interior or exterior shipboard environment 100 is illustrated, showing a deck 110 and at least one bulkhead 112. A mission module is illustrated as a parallelepiped 114, and it represents any one of a plurality of possible modules, which might be combat control, radar, fire control, sonar, navigation, environmental control, or like modules. The module is placed at a convenient location on the deck. Bulkhead 112 bears utility connections, such as an electric connection or outlet 116, coolant pipe connections 118*a*, 118*b*, and communications connections 120. Space is left between the selected location of module 114 and the bulkhead 112 to allow the various utility connections to be made. For this reason, the utility connection wire cables, hoses or pipes 121, 122*a*, 122*b*, etc extend over a significant length.

Figure 2A:
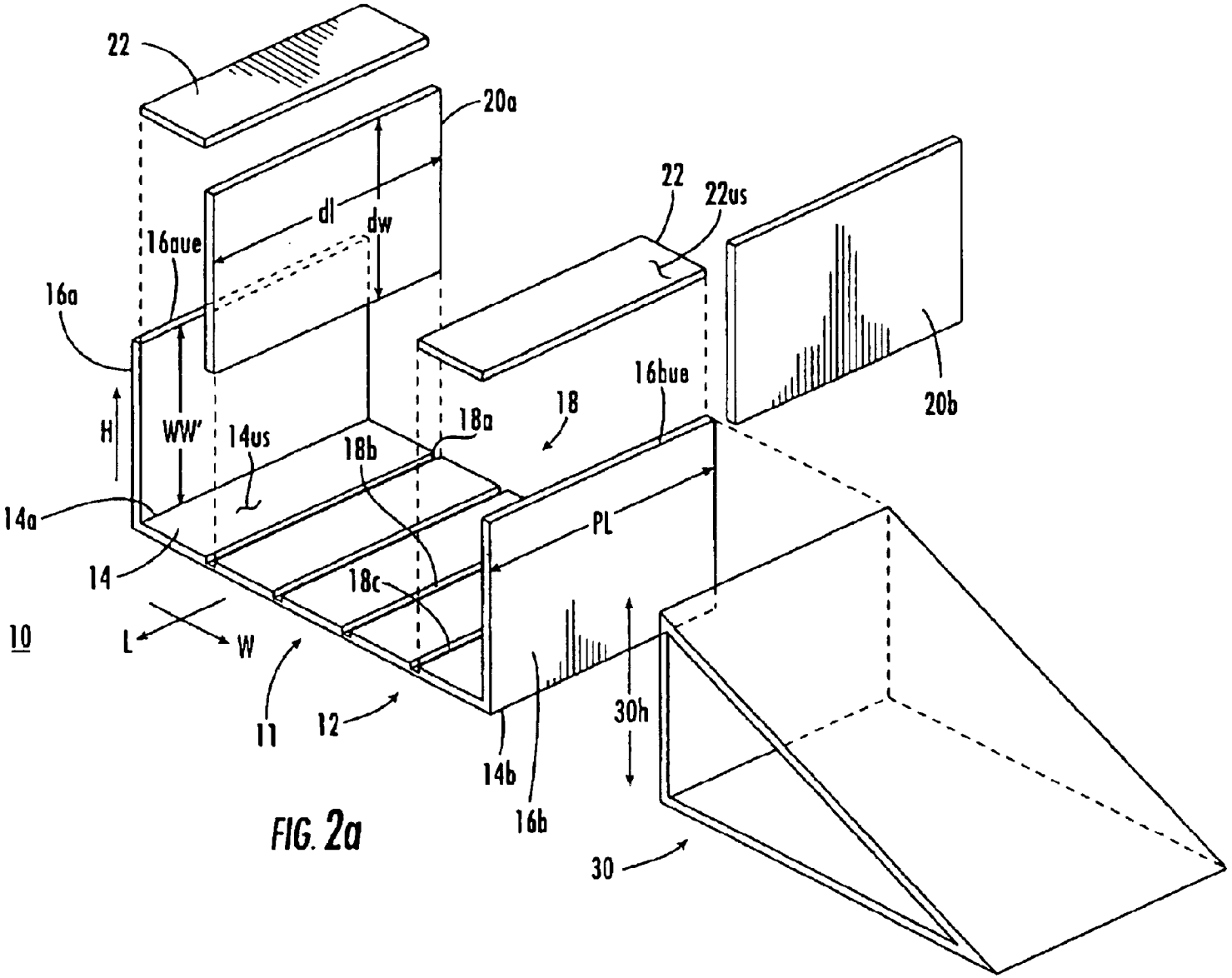
FIG. 2*a* is a simplified perspective or isometric View, partially exploded, of a kit of parts according to an aspect of the invention, for covering utility connections in the arrangement of FIG. 1*a*.

FIG. 2*a* illustrates a kit of parts 10 which may be useful in protecting personnel against injury to themselves or to the utility connections. In general, the kit of parts 10, when assembled, defines a box channel which lies between the bulkhead 112 and the mission module 114 of FIG. 1*a*, including ramps to aid in walking over the box channel, and also including provision for separate conduits extending through the channel to separately accommodate the utility connections.

In FIG. 2*a*, a generally open or U-shaped channel (U-channel) 12 is defined by a baseplate 14 and upstanding side walls 16*a*, 16*b*. The length of U-channel 12 lies in the length direction L, and the channel width CW lies in the width direction W. A height direction H is orthogonal to length direction L and width direction W. As illustrated in FIGS. 2*a*, 2*b*, 2*c*, and 2*d*, U-channel 12 includes a baseplate 14 defining upper and lower broad surfaces 14*us* and 141*ls*, respectively. The length of U-channel 14 in length direction L is some standard or predetermined length PL, such as, for example, two feet. As described below, two-foot sections of the U-channel can be concatenated end-to-end to accommodate longer channel lengths than two feet, and any requirement for a length less than two feet, to fill a length not in two-foot increments, can be accommodated by cutting a single section to the desired length. A first vertically oriented rectangular planar side wall 16*a* is affixed along a first edge 14*a* of baseplate 14, and a second vertically oriented rectangular planar side wall 16*b* is affixed along a second edge 14*b* of baseplate 14. The lengths of planar walls 16*a* and 16*b* in the length direction L are equal to the predetermined length PL of the baseplate 14. The vertical extent or "width" ww of walls 16*a* and 16*b* are selected to provide a suitable "depth" to the channel 11 defined by the baseplate 14 and upstanding walls 16*a*, 16*b*. The depth must, of course, be enough to accommodate the utility connections, and should preferably provide sufficient extra room for expansion of the utility functions.

A set 18 of slots including a plurality of slots illustrated as 18*a*, 18*b*, and 18*c* are formed or defined in the upper surface 14*us* of baseplate 14 of U-channel 12, as illustrated in FIG. 2*a*. These slots are elongated, and have a length direction which parallels the length direction L of the U-channel 12. As illustrated in more detail in FIG. 2*d*, the slots such as 18*a* have a rectangular cross-section, and a width sw.

Figure 2B:
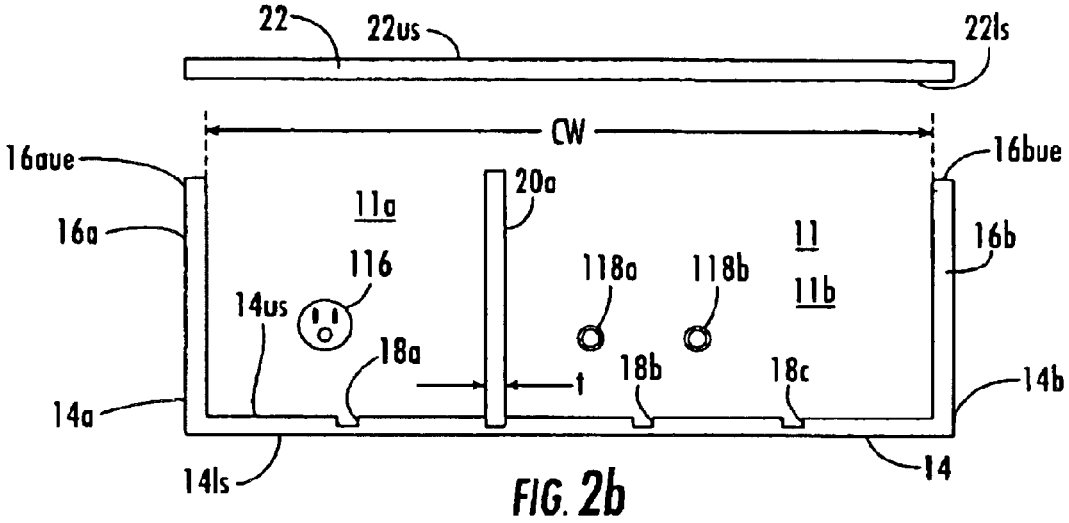
FIG. 2*b* is a cross-sectional view of the arrangement of FIG. 1 in a partially assembled form showing one way that an internal divider can make connection to a slot.
Figure 2C:
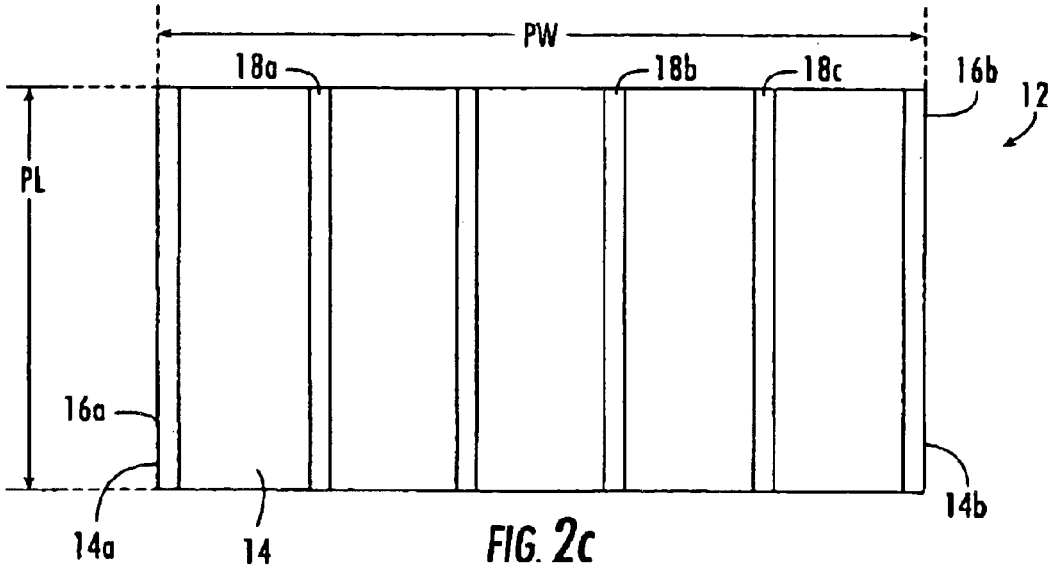
FIG. 2*c* is a plan view of the U-channel or baseplate portion of the kit of parts of FIGS. 2*a* and 2*b*.
Figure 2D:
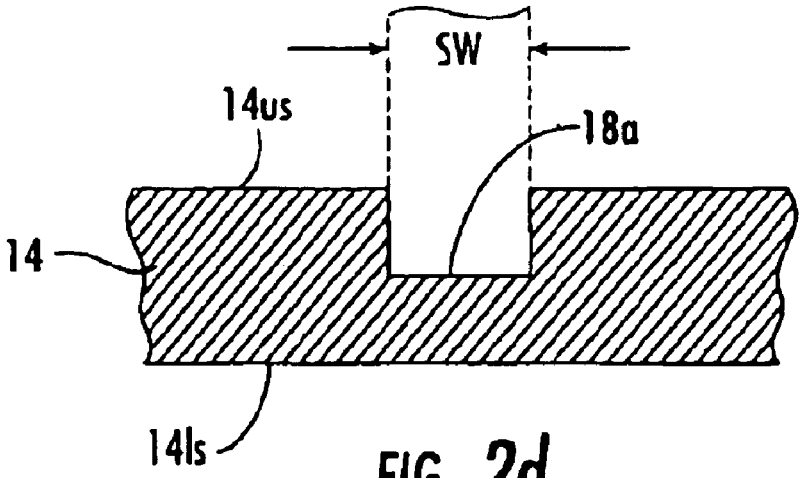
FIG. 2*d* is a detail illustrating a cross-section of one kind of slot used in the U-channel of FIGS. 2*a*, 2*b*, and 2*c*.
Figure 2E:
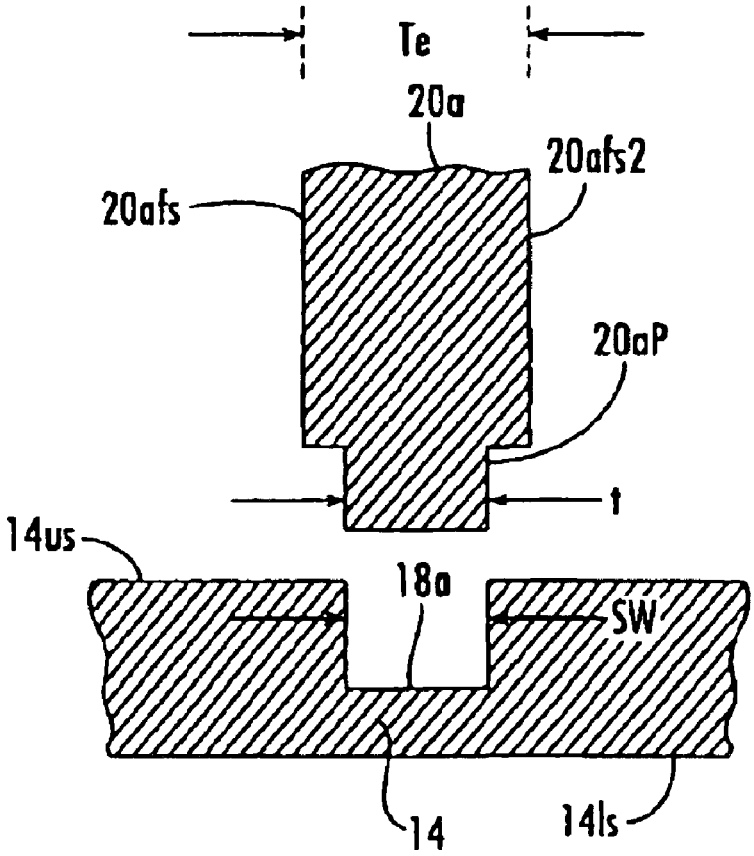
FIG. 2*e* is a detail illustrating another way a connection can be made to the slot of FIG. 2*d;*

The kit of parts 10 of FIGS. 2*a*, 2*b*, 2*c*, and 2*d* also includes at least one interior divider element or wall, illustrated as a rectangular planar divider 20*a*. Divider 20*a* has length dl in the length direction L which equals the particular length PL of the baseplate 14 of the U-channel 12. Divider 20*a* also has a width or height dimension dw approximately equal to the corresponding width or height dimensions of the walls 16*a*, 16*b*. As illustrated in FIG. 2*b*, the lowermost edge of divider 20*a* has a thickness t, which is selected to be accommodated in a slot of width sw. In this context, the fit need not be an interference fit, but should be snug. FIG. 2*d* illustrates a detail of the baseplate 14, showing the cross-sectional shape of a particular embodiment of slot 18*a*. Other embodiments are possible. In FIG. 2*b*, the entire divider has thickness t, while in FIG. 2*e* the main planar body of divider 20*a* has first and second broad flat sides 20*afs*1 and 20*afs*2 and a thickness Te. At the lower edge of divider 20*a* of FIG. 2*e*, a protruding portion 20*a*P has a thickness t, less than the thickness Te.

As illustrated in FIGS. 2*a* and 2*b*, a planar cover 22 of kit of parts 10 is dimensioned to cover the U-channel 12. More particularly, cover 22 has a length dimension in length direction L which equals PL, the length of the U-channel 12, and has a width selected to extend between and be supported by the upper edges 16*aue* and 16*bue*, respectively, of walls 16*a* and 16*b*. For ease of referring to this dimension, it is deemed to be equal to the channel width CW, but will be understood to be greater than channel width CW by twice the thickness of a vertical wall 16*a*. The upper surface of cover 22 is designated 22*us*, and the lower surface 22*ls*. FIG. 2*b* also illustrates that, when the divider 20*a* is in place within slot 18*b* of the U-channel, the complete channel 11 is divided into two separate portions 11*a* and 11*b*. In the view of FIG. 2*b*, it can be seen that the electrical socket 116 on the bulkhead wall is aligned with channel portion 11*a*, and that the pipe connections 118*a* and 118*b* are aligned with channel portion 11*b*.

While the kit of parts 10 has so far been described as including but a single interior divider 20*a*, the kit may contain a set of interior dividers including additional interior dividers, one of which is illustrated as 20*b* in FIG. 2*a*. In general, it will not be useful to include within the kit of parts 10 a set of dividers having a greater number of dividers, such as 20*a* and 20*b*, than there are slots in set 18 of slots. Each of the dividers in set 18 of dividers will be identical to others of the set.

While not a part of the kit of parts according to the invention, the kit of parts 10 may be accompanied by an additional ramp or set of ramps. A single ramp 30 is illustrated in FIG. 2*a*. The ramp has a height 30*h* which is substantially equal to the height at which the upper surface 22*us* of cover 22 lies when the kit of parts is assembled.

Figure 3:
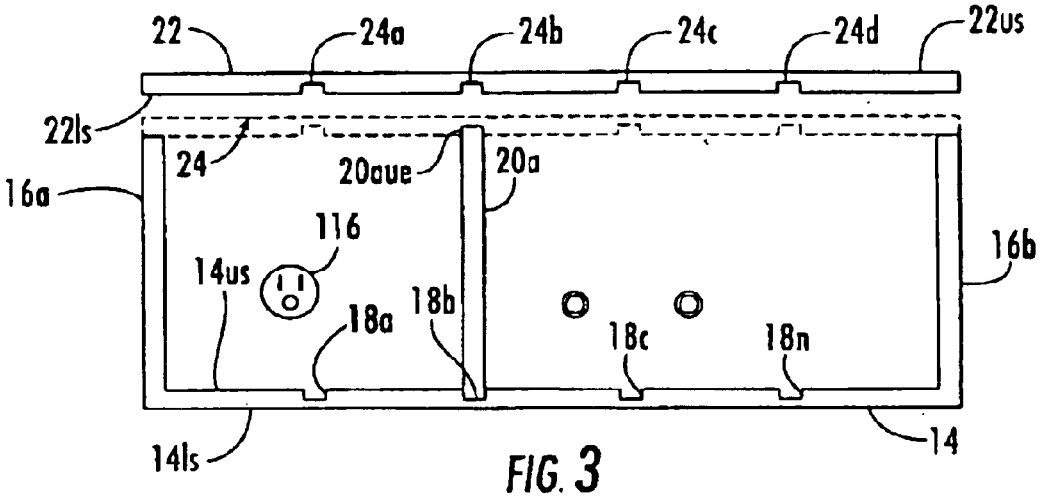
FIG. 3 is a simplified cross-section of another kit of parts, partially assembled, showing a cover or lid arranged with slots for receiving upper portions of internal dividers.

FIG. 3 is similar to FIG. 2*a*, and corresponding elements are designated by like reference alphanumerics. In FIG. 3, the lower surface 22*ls* of cover 22 has a set 24 of rectangular slots 24*a*, 24*b*, 24*c*, and 24*d*. The widths of the slots of set 24 are selected to accommodate the upper edge of an interior divider, and their locations are selected to overlie a corresponding slot of set 18 of slots. In FIG. 3, each slot of set 24 of slots has a width adapted to accept upper edge 20*aus* of interior divider 20*a*, and each slot of set 24 of slots overlies a slot of set 18 of slots in baseplate 14. More particularly, slots 24*a*, 24*b*, 24*c*, and 24*d* of set 24 of slots in cover 22 overlies corresponding slot 18*a*, 18*b*, 18*c*, and 18*n* of set 18 of slots, so that any interior divider, such as divider 20*a*, may have its upper edge 20*aue* accommodated in any one of the slots of set 24. Of course, if the kit of parts 10 includes plural interior dividers, any or all may be accommodated in the assembled structure, up to a number of dividers which equals the number of available slot sets 18, 22.

Figure 4A:
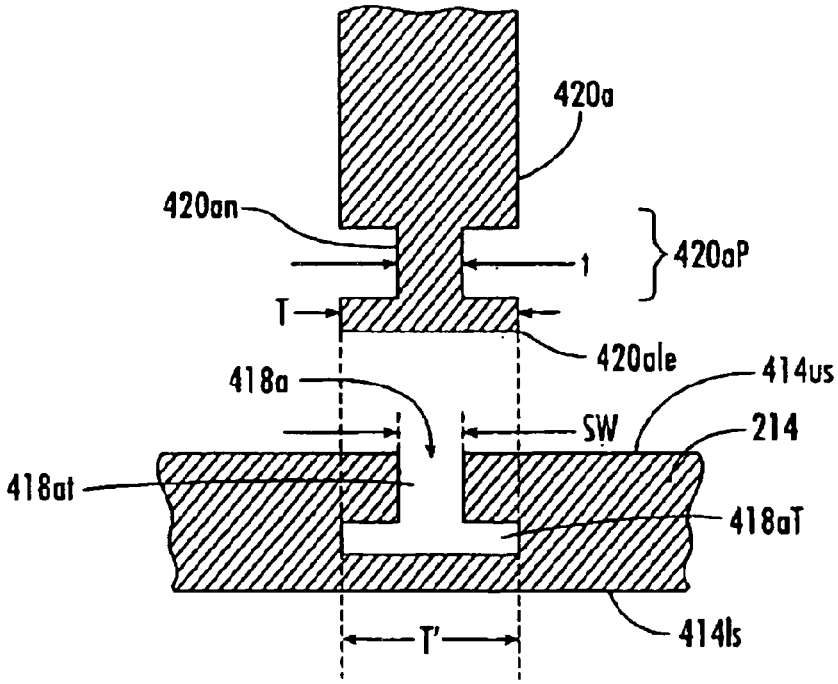
FIG. 4*a* is a simplified cross-section of an alternative slot and internal divider arrangement according to an aspect of the invention.

FIG. 4*a* illustrates an alternative shape for the lower edges of the interior dividers and slots. In FIG. 4*a*, the interior divider is designated 420*a*, to indicate that it differs from interior dividers of set 20. As illustrated in FIG. 4*a*, the lower edge portion 420*a*P of divider 420*a* defines two different thicknesses, in a configuration which has somewhat of the appearance of a flange. More particularly, the lowermost edge 420*e* of divider 420*a* has a thickness T which equals the thickness of the main portion of the divider, and a neck region 420*an* which has a lesser thickness t. FIG. 4*a* also shows that the mating slot 418*a* defined in the upper surface 414*us* of a baseplate 414 has a necked shape including a region 418*a*T with a width T and a neck region 418 at connection region 418*a*T with the upper surface 414*us* of the baseplate 414. The dimensions of the slot 418*a* are selected to accommodate the necked region 420*a*P of divider 420*a*. In actual use, the necked region 420*a*P of standard-length divider 420*a* is slipped into the tee-slot 418*a* from the end of the baseplate, so the fit must be a slip fit. It will be appreciated that once installed, the divider 420*a* of FIG. 4*a* cannot come loose from the baseplate 414.

Figure 4B:
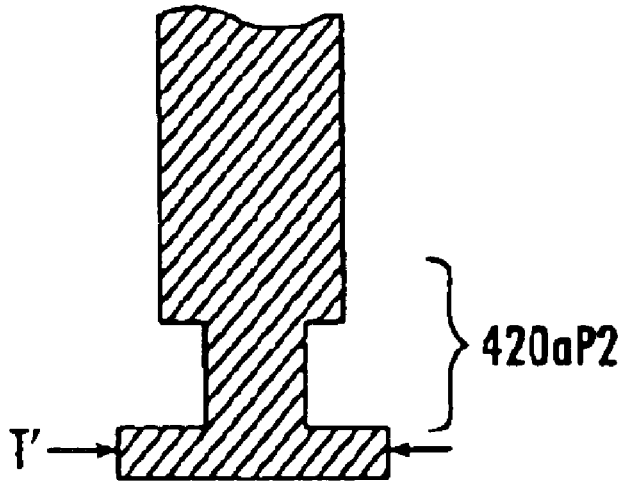
FIGS. 4*b* and 4*c* illustrate variants of the divider portions thereof.
Figure 4C:
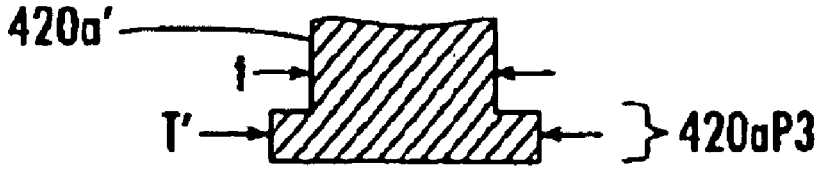

FIG. 4*b* shows the edge portion 420*a*P2 of an alternative interior divider, in which the lowermost portion has a thickness T' greater than the thickness of the main body of the divider. FIG. 4*c* shows a divider 420*a*' in which the protruding portion 420*a*P3 having thickness T" is attached directly to the lowermost edge of the full-thickness (t) portion of the body of the divider. The shape of the slot to accommodate the protrusions 420*a*P2 or 420*a*P3 must, of course, correspond with the shape of the protrusion with which it is to be used.

Figure 5:
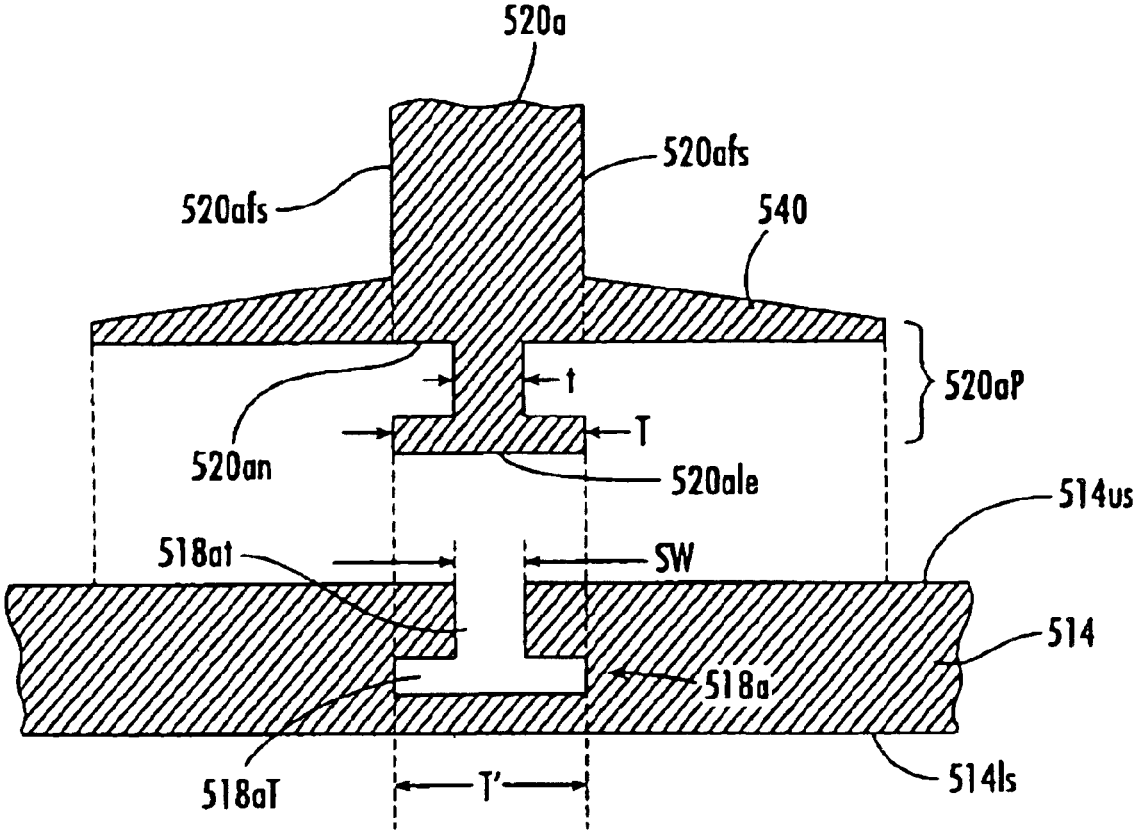
FIG. 5 is a simplified cross-section of an arrangement according to another aspect of the invention, similar to the arrangement of FIG. 4*a*, in which the internal divider includes a flange.

Those skilled in the art will recognize that if lateral forces are repeatedly applied to the upper edges of the dividers illustrated in FIG. 4*a* or 4*b*, stresses may form in the neck regions 420*an*, which may undesirably result in fracture at the neck and loosening of the divider from the baseplate. The arrangement of FIG. 5 can aid in overcoming such stresses. The arrangement of FIG. 5 is similar to that of FIG. 4*a*, but further includes a flange region. More particularly, in the arrangement of FIG. 5, an interior divider designated generally as 520*a* includes a generally planar body portion defining first and second broad surfaces 520*afs*1 and 520*afs*2. A protruding lowermost portion 520*a*P defines a neck portion 520*an* with a thickness t and a further portion 520*ale* with a thickness T. A tee-shaped slot defined in the upper surface 514*us* of a baseplate 514 includes a region 518*a*T having a thickness or width T', together with a neck portion 518*at* of thickness t which connects region 518*a*T with upper surface 514*us* of baseplate 514.

In addition, the arrangement of FIG. 5 includes a flange 540 affixed to that lowermost portion of the divider body which lies above protruding portion 520*a*P. As illustrated, flange 540 extends laterally away from the body portion of divider 520*a*, and is dimensioned to be substantially coplanar with the upper surface 514*us* of baseplate 514 when the protruding portion 520*a*P engages tee-shaped slot 518*a*. The flange provides a relatively large moment arm for resisting lateral forces applied to the upper edge of the divider.

A kit of parts (10) according to an aspect of the invention comprises at least one U-channel (12). The U-channel (12) comprises a planar baseplate (14) defining upper (14*us*) and lower (14*ls*) broad surfaces. The U-channel (12) has a predetermined length (PL) in a length (L) direction, and a width (W) between first (14*a*) and second (14*b*) sides extending parallel to the length (L) direction. The predetermined length (PL) is no greater than the distance between a bulkhead (112) and a mission module (114) between which the baseplate (14) will installed. The U-channel (12) further comprises first (16*a*) and second (16*b*) planar mutually parallel walls, each having the predetermined length (PL) in the length direction. The first wall (16*a*) is attached to the first side (14*a*) of the baseplate (14), with the length direction of the first wall (16*a*) parallel with the length direction of the baseplate (14). The first wall (16*a*) has a width dimension (ww). The first wall (16*a*) extends above the upper side (14*us*) of the baseplate (14), orthogonal to the upper broad surface (14*us*) of the baseplate (14). The second wall (16*b*) is attached to the second side (14*b*) of the baseplate (14), with the length direction of the second wall (16*b*) parallel with the length direction of the baseplate (14). The second wall has a width dimension (ww). The second wall (16*b*) extends above the upper side (14*us*) of the baseplate (14) and orthogonal to the upper broad surface (14*us*) of the baseplate (14). The first (16*a*) and second (16*b*) walls, together with the baseplate (14), define a generally U-shaped channel (12) defining a length (PL) in a direction parallel with the length direction (L), and also defining a channel width (cw). The baseplate (14) further comprises at least a first slot (18*a*, 418*a*, 518*a*) in the upper surface (14*us*) of the baseplate (14). The first slot (18*a*, 418*a*, 518*a*) has a length extending parallel with the length direction (L). The first slot (18*a*, 418*a*, 518*a*) has at least a first predetermined width dimension (SW, t). The kit of parts (10) further includes a divider (20) comprising a generally planar rectangular element defining a length dimension (dl) equal to the predetermined length dimension (PL), a width dimension (dw) approximately equal to the width dimension (ww) of the first (16*a*) and second (16*b*) walls, and a first thickness (t) along at least a selected (lower) portion of the edges thereof which is no greater than the first predetermined width (sw) of the slot (18*a*). A generally planar rectangular cover (22) is included. The cover (22) has a length dimension equal to the predetermined length (PL), and a width dimension approximately equal to the channel width (cw).

In a preferred embodiment of this aspect of the invention, the baseplate (14) of the kit of parts (10) further comprises at least a second slot (18*b*) in the upper surface (14*us*) of the baseplate (14). The second slot (18*b*) extends parallel with the length direction (L) and with the first slot (18*a*). The second slot (18*b*) has at least the first predetermined width (sw, t) dimension. If desired, the kit of parts (10) may further comprise a second divider (20*b*) comprising a generally planar rectangular element defining a length dimension equal to the predetermined length dimension (PL), a width dimension (dw) approximately equal to the width dimension (ww) of the first (16*a*) and second (16*b*) walls and a first thickness (t) along at least a selected portion (lower edge) of an edge thereof which equals the first predetermined width (sw) of the slot (18*a*). In one particularly advantageous embodiment of this aspect of the invention, the first divider (20*a*) comprises a monolithic flange (540) adjacent the selected (lower) portion thereof.

According to another most preferred embodiment of this aspect of the invention, the first slot (418*a*, 518*a*) of the baseplate (14) of the kit of parts (10) comprises a first (418*at*, 518*at*) portion having the width (sw, t). The first slot portion (418*at*, 518*at*) is adjacent to the upper surface (14*us*) of the baseplate (14) and remote from the lower surface (14*ls*) of the baseplate (14). The first slot (418*a*, 518*a*) also comprises a second slot portion (418*a*T, 518*a*T) having a second width (T, T'), where the first width (sw) is less than the second width (T, T'). The second portion (418*a*T, 518*a*T) of the first slot (418*a*, 518*a*) is continuous with the first slot portion (418*at*, 518*at*). In this most preferred embodiment, the divider has a region having a second thickness (T, T'), greater than the first thickness (t) adjacent the selected (lower) edge, and has a region having the first thickness (t) at a location adjacent the region having the second thickness (T) and more remote from the selected (lower) edge of the divider.

What is claimed is:

1. A kit of parts, said kit of parts comprising:

at least one U-channel comprising a planar baseplate defining upper and lower broad surfaces, and having a predetermined length in a length direction, a width between first and second side edges extending parallel to said length direction, said predetermined length being no greater than the distance between a bulkhead and a mission module between which said baseplate will be installed, said U-channel further comprising first and second planar mutually parallel walls, each having said predetermined length in said length direction and a thickness, said first wall being attached to said first side edge of said baseplate with said length direction of said first wall parallel with said length direction of said baseplate, said first wall extending orthogonally above said upper surface of said baseplate, said second wall being attached to said second side edge of said baseplate with said length direction of said second wall parallel with said length direction of said baseplate, said second wall extending orthogonally above said upper surface of said baseplate, said first and second walls together with said baseplate defining a generally U-shaped channel defining a length in a direction parallel with said length direction, and also defining a channel width, said baseplate further comprising at least a first slot in said upper surface of said baseplate, said first slot having a length extending parallel with said length direction, said first slot having at least a first predetermined width dimension;

a divider comprising a generally planar rectangular element defining a length dimension equal to said predetermined length dimension, a width dimension approximately equal to the width dimension of said first and second walls and a first thickness along at least a selected portion of the edges thereof which is no greater than said first predetermined width of said slot; and a generally planar rectangular cover, said cover having a length dimension equal to said predetermined length, and a width dimension no greater than the sum of said channel width and said thicknesses of said first and second walls.

2. A kit of parts according to claim 1, wherein said baseplate further comprises at least a second slot in said upper surface of said baseplate, said second slot extending parallel with said length direction and with said first slot, said second slot having at least said first predetermined width dimension, said cover of said kit of parts defining a cover slot extending in said length direction, said cover slot having a second predetermined width dimension.

3. A kit of parts according to claim 2, further comprising a second divider comprising a generally planar rectangular element defining a length dimension equal to said predetermined length dimension, a width dimension approximately equal to said width dimension of said first and second walls, a first thickness along at least a selected portion of the edges thereof which equals said first predetermined width of said slot, and a second thickness along another selected portion of said edges of said divider, said second thickness being equal to said second predetermined width dimension.

4. A kit of parts according to claim 1, wherein said first divider comprises a monolithic flange adjacent to said selected portion of said edge thereof, and spaced away from said edge thereof.

5. A kit of parts according to claim 1, wherein:

said first slot of said baseplate comprises a first portion having said predetermined width, said first slot first portion being adjacent to said upper surface of said baseplate and remote from said lower surface of said baseplate and also comprises a second slot portion having a second width greater than said width, said second portion of said first slot being continuous with said first slot portion; and said divider includes a region having a second thickness, greater than said first thickness adjacent said selected portion of said edges, and has said region having said first thickness at a location adjacent said region having said second thickness and more remote from said selected portion of said edges of said divider.

6. A method for connecting utilities from a bulkhead to a mission module mounted on a deck at a distance from a bulkhead, said method comprising the steps of:

procuring a kit of parts, said kit of parts comprising:

at least one U-channel comprising a planar baseplate defining upper and lower broad surfaces, and having a predetermined length in a length direction, a width between first and second side edges extending parallel to said length direction, said predetermined length being no greater than the distance between a bulkhead and a mission module between which said baseplate will installed, said U-channel further comprising first and second planar mutually parallel walls, each having said predetermined length in said length direction and a thickness, said first wall being attached to said first side edge of said baseplate with said length direction of said first wall parallel with said length direction of said baseplate, said first wall extending orthogonally above said upper surface of said baseplate, said second wall being attached to said second side edge of said baseplate with said length direction of said second wall parallel with said length direction of said baseplate, said second wall extending orthogonally above said upper surface of said baseplate, said first and second walls together with said baseplate defining a generally U-shaped channel defining a length in a direction parallel with said length direction, and also defining a channel width, said baseplate further comprising at least a first slot in said upper surface of said baseplate, said first slot having a length extending parallel with said length direction, said first slot having at least a first predetermined width dimension;

a divider comprising a generally planar rectangular element defining a length dimension equal to said predetermined length dimension, a width dimension approximately equal to the width dimension of said first and second walls and a first thickness along at least a selected portion of the edges thereof which is no greater than said first predetermined width of said slot; and a generally planar rectangular cover, said cover having a length dimension equal to said predetermined length, and a width dimension no greater than the sum of said channel width plus said thicknesses of said side walls;

placing said selected portion of said divider in said first slot;

mounting said baseplate on said deck, with said lower broad surface adjacent said deck, at a location lying between said bulkhead and said mission module, with said length dimension of said baseplate lying parallel to a line connecting said bulkhead to said mission module, to thereby divide said generally U-shaped channel into plural sections;

extending a utility connection through one of said plural sections from a location on said bulkhead to a location on said mission module; and placing said cover over said generally U-shaped channel.

7. A method according to claim 6, wherein said step of placing said selected portion of said first divider in said first slot is performed after said step of mounting said baseplate on said deck.

8. A kit of parts according to claim 1, wherein:

said cover defines upper and lower surfaces;

and said lower surface of said cover defines at least one elongated second slot having a length extending parallel with said length direction, said second slot having at least said first predetermined width dimension.

9. A kit of parts according to claim 8, wherein said second slot is located on said cover at a location such that it is registered with said slot in said upper surface of said baseplate when said kit of parts is assembled.

10. A method according to claim 6, wherein said cover defines upper and lower surfaces; and said kit of parts comprises at least one elongated second slot in said lower surface of said cover, said second slot having a length extending parallel with said length direction, and being registered with said first slot when said kit of parts is assembled; and said step of placing said cover includes the step of engaging an edge of said divider in said second slot.

11. A method according to claim 10, wherein said step of engaging an edge of said divider in said second slot is performed after said step of placing said selected portion of said divider in said first slot.

12. A kit of parts, said kit of parts comprising:

at least one U-channel comprising a planar baseplate defining upper and lower broad surfaces, and having a predetermined length in a length direction, a width between first and second side edges extending parallel to said length direction, said predetermined length being no greater than the distance between a bulkhead and a mission module between which said baseplate will be installed, said U-channel further comprising first and second planar mutually parallel walls, each having said predetermined length in said length direction and a thickness, said first wall being attached to said first side edge of said baseplate with said length direction of said first wall parallel with said length direction of said baseplate, said first wall extending orthogonally above said upper surface of said baseplate, said second wall being attached to said second side edge of said baseplate with said length direction of said second wall parallel with said length direction of said baseplate, said second wall extending orthogonally above said upper surface of said baseplate, said first and second walls together with said baseplate defining a generally U-shaped channel defining a length in a direction parallel with said length direction, and also defining a channel width, said baseplate further comprising at least a first slot in said upper surface of said baseplate, said first slot having a length extending parallel with said length direction, said first slot having at least a first predetermined width dimension, said slot also comprising a second portion lying between said upper and lower surfaces of said baseplate, said second portion having a second predetermined width dimension greater than said first predetermined width dimension;

a divider comprising a generally planar rectangular element defining a length dimension equal to said predetermined length dimension, a width dimension approximately equal to the width dimension of said first and second walls and a selected edge, said divider defining a first portion lying parallel with said selected edge and having said first predetermined width dimension, said divider also defining a second portion lying parallel with said first portion and closer to said selected edge than said first portion, said second portion having said second width dimension, said divider further comprising a flange lying adjacent said first portion of said divider and more remote from said selected edge than said first portion of said divider, said flange having a width dimension greater than said first predetermined width dimension; and a generally planar rectangular cover, said cover having a length dimension equal to said predetermined length, and a width dimension approximately equal to said channel width.

* * * * *